United States Patent [19]

McDonald

[11] 4,122,650

[45] Oct. 31, 1978

[54] PAPER CARRIER FOR ROLL PAPER MACHINES

[76] Inventor: W. B. McDonald, 6460 S. Virginia St., Reno, Nev. 89502

[21] Appl. No.: 563,345

[22] Filed: Mar. 31, 1975

[51] Int. Cl.[2] ..... B65B 41/12

[52] U.S. Cl. ..... 53/389; 53/212

[58] Field of Search ..... 53/212, 389, 211; 242/76; 226/197

[56] References Cited

U.S. PATENT DOCUMENTS

| | | | |
|---|---|---|---|
| 1,790,559 | 1/1931 | Swift, Jr. | 226/197 X |
| 2,716,315 | 8/1955 | Jacoby | 53/389 X |
| 3,392,927 | 7/1968 | Clurman | 226/197 X |
| 3,657,974 | 4/1972 | Hedrich et al. | 226/197 |
| 3,775,940 | 12/1973 | Hatanaka | 53/212 |
| 3,802,615 | 4/1974 | Bundschuh | 242/76 X |

FOREIGN PATENT DOCUMENTS

| | | | |
|---|---|---|---|
| 1,289,113 | 2/1969 | Fed. Rep. of Germany | 226/197 X |

*Primary Examiner*—John Sipos

*Attorney, Agent, or Firm*—Herbert C. Schulze

[57] ABSTRACT

A device for feeding paper to a coin wrapping machine by guiding of the paper from a roll to the machine. The guide includes a rotatable roller positioned in parallel relationship to the paper roll and a non-rotatable bar that guides the paper from the roller into the machine at a ninety degree relationship to the axis of the roller.

3 Claims, 4 Drawing Figures

PAPER CARRIER FOR ROLL PAPER MACHINES

CROSS REFERENCES TO RELATED PATENT APPLICATIONS

There are no related patent applications filed by me.

BACKGROUND OF THE INVENTION

1. Field of the Invention

This invention is in the general field of coin wrapping machines, wherein coins are wrapped in rolls of given quantities and wherein the roll of coins is cased in a peper covering, and other machines, such as cash registers, and the like, wherein rolls of paper are used; the invention is more particularly directed to a carrier for a large roll of paper which may be used for such machines, from which paper is carried into the machine and properly fed, and/or cut, and wrapped about the roll of coins, or otherwise utilized in the normal function of the machine.

2. Description of the Prior Art

The prior art in this field comprises means holding an enlarged paper roll, generally horizontally disposed towards the machine so as to directly feed therein and at a distance from the machine so as to require an unfortunately large amount of working space.

The present invention is distinguished from the prior art by its unique features of vertical displacement of the roll of paper combined with guide roller and bar feeding the paper appropriately so that it does not misalign on entering the machine, and it features a simplified tension device for insuring uniform tension on the enlarged roll of paper.

SUMMARY OF THE INVENTION

Businesses in which large numbers of coins are utilized, such as banks, coin operated machine businesses and the like, frequently utilize machines, which are well known in the art, for counting the coins and placing them in fixed quantities in paper wrapping, commonly referred to as "rolls" of coins. For example, some standard rolls are rolls of 25 cent pieces, 10 cent pieces, and the like. These rolls are well standardized and well known in the art.

The machines which perform this function of wrapping of the rolls are made by different manufacturers, and a number of them are known to those skilled in the art. One such machine in wide use is the Brandt machine, well known to those skilled in the art. This machine is a particularly fine machine; but, comes to the user with a holder for a small roll of paper and an optional, cumbersome, vertical stand designed to hold a larger roll of paper which feeds into the machine to the side, and at a distance from the machine occupying considerable floor space and accommodating only a limited size roll of paper suitable to wrap a limited number of rolls of coins.

It is, of course, most desirable to have an extremely large roll of paper available in such machines since considerable time is lost in replacing the smaller rolls where machines are in frequent and continued use. The optional stand described, has been utilized in an attempt to provide a suitable large roll of paper. Since space, however, is extremely costly, the desirability of using such a stand in an auxiliary manner as has been heretofore available has always been questionable.

Others have made attempts to provide a more satisfactory means for carrying the roll of paper and attempts have even been made to have a vertical carrier more closely associated with the machine. This creates a problem of the appropriate feed of the paper since the paper ultimately enters the machine at a 90° angular relationship to the vertically disposed paper.

There are of course other machines having similar problems. Cash registers in super markets and the like frequently utilize a roll of paper of limited size. In very active operations, it is frequently necessary to insert a new roll of paper and each time this is done creates considerable loss of time of personnel and frequently loss of time for customers standing in line. There are other machines using rolls of paper, also, and I have studied the overall problem completely.

In my studies of this problem I have done much development and experimental work and have finally conceived and developed an improved, new, and unique means for carrying a large roll of paper and feeding it, without problems, by one simple roller and one simple guide bar, properly disposed at a critical angular relationship to the machine and the paper, in combination with an appropriate adapter to replace the standard small roll in the machine and a proper tensioning device for the large roll of paper. The unique and maintenance free tensioning device maintains the proper tension at all times, regardless of the amount of paper roll, so that the functioning of the machine is always correct and so that the paper always feeds properly during operation.

Some types of equipment for larger rolls than the machine was designed for adds severe drag in feed rollers, shortening machine life and causing vertical paper aligning problems.

It is an object of this invention to provide an apparatus for carrying a large roll of paper used to wrap coins in conjunction with, and vertically disposed with relation to, a coin wrapping machine;

Another object of this invention is to provide such a device as aforementioned wherein a guide roller and a guide bar prevent misallignment of the paper in the feeding into the machine;

Another object of this invention is to provide a device as described wherein proper tensioning of the paper is achieved by simple mechanical means;

Another object of this invention is to provide a device as described wherein a large paper roll may be used with other types of roll paper utilizing machines.

The foregoing and other objects and advantages of this invention will be apparent to those skilled in the art upon reading the description of a preferred embodiment which follows, and in conjunction with a review of the appended drawings.

DESCRIPTION OF A PREFERRED EMBODIMENT

Figure 1:
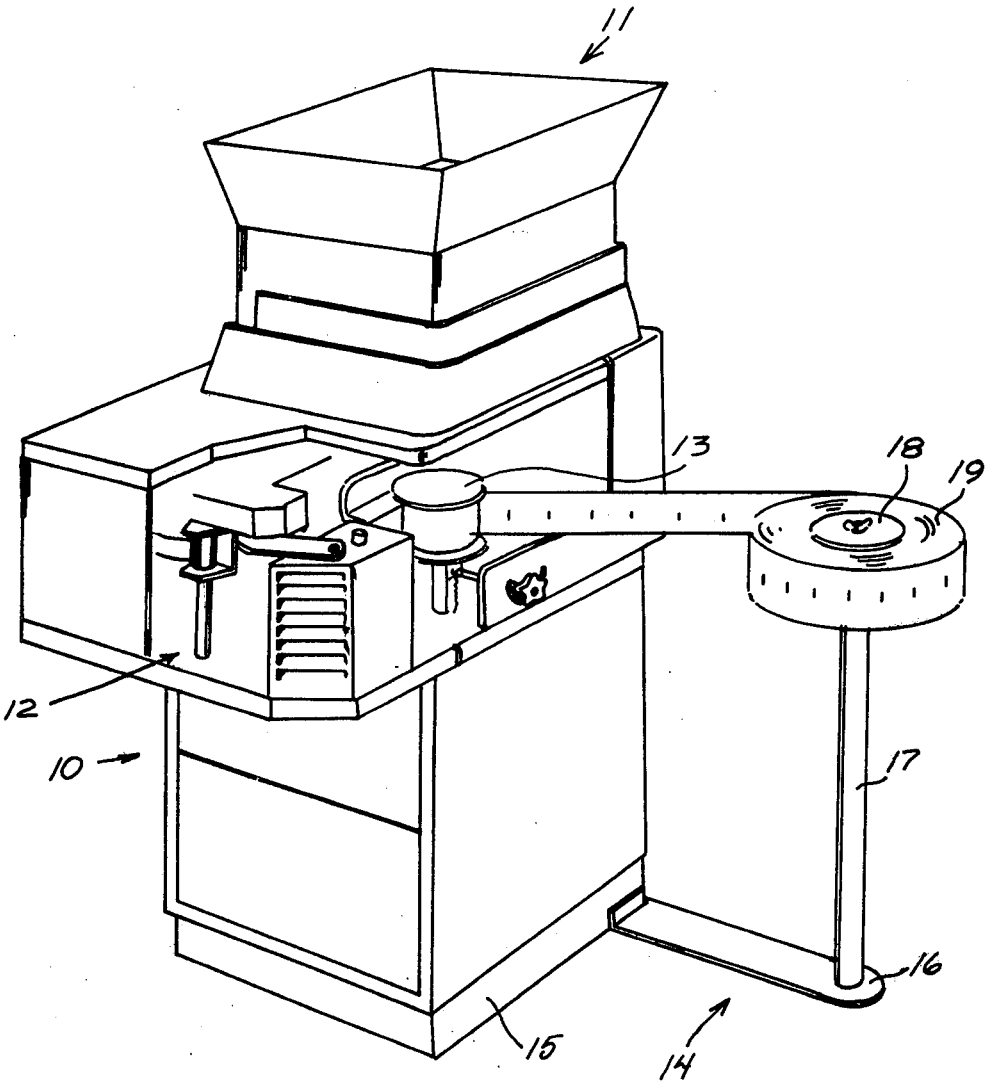
FIG. 1 is a perspective of a coin wrapping machine, including an embodiment of a prior auxiliary paper carrier.

Attention should first be given to FIG. 1 which illustrates a customary coin wrapping machine 10 (in this case a machine similar to the Brandt machine, known to those skilled in the art, is illustrated). The coin machine has a hopper 11 for receiving coins and the appropriate mechanism 12 within the machine for counting and rolling the coins by means known to those skilled in the art and which need no explanation here. Such coin wrapping machines customarily have a paper roll holding device 13 consisting of a pair of flanges and a spindle which holds a very small roll of paper within the confines of the machine, again as known to those skilled in the art. It is to be understood that similar rolls of paper for cash registers and other equipment exists. The workings of such machines are of no consequence here since they are known to those skilled in the art.

As an option, the device 14 comprising a base 15 upon which the machine rests, a suitable bracket 16 attached to the base, with an elongated axle 17 having a par roll spindle 18 at its upper portion is illustrated. A larger roll of paper than that which fits within the machine on the spindle 13 may be fed, and such a roll of paper 19 is illustrated feeding into the machine. It is to be observed that a great deal of space is taken up by such a device and because of space requirements the size of the roll 19 is, by practical considerations, limited.

Figure 2:
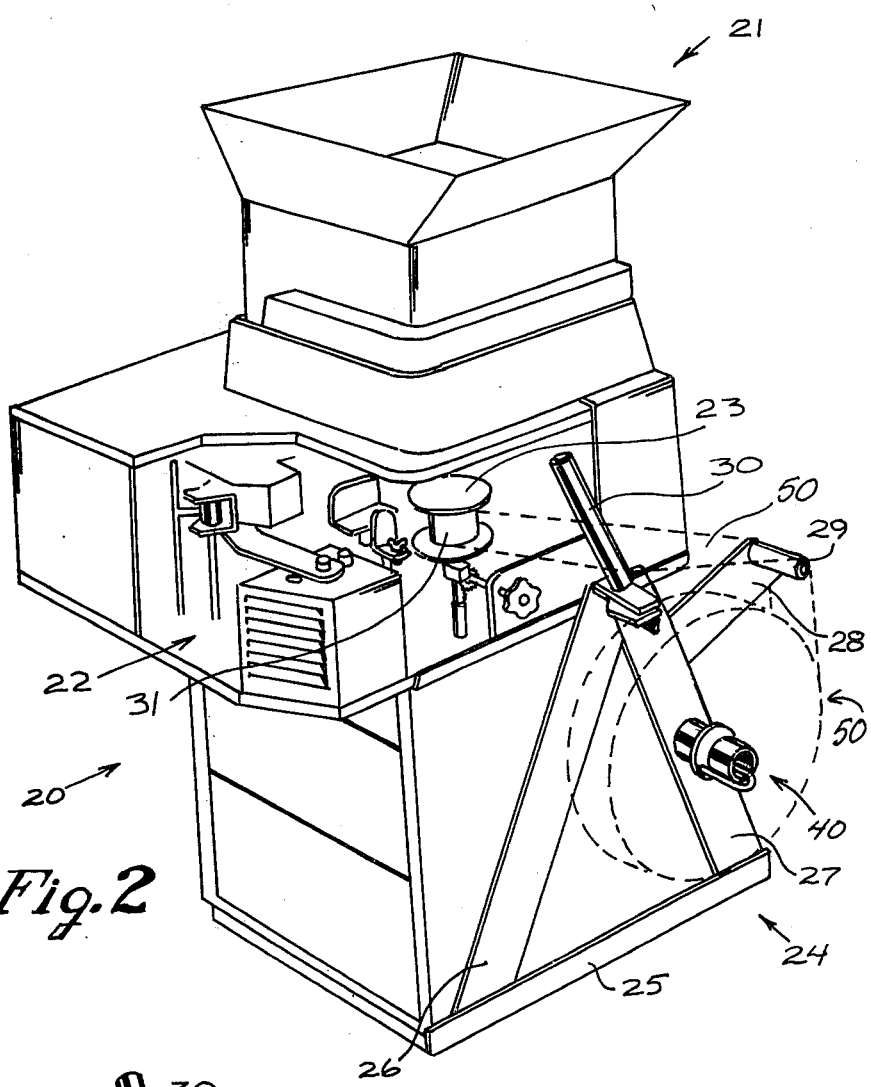
FIG. 2 is a perspective of the machine for wrapping coins of FIG. 1, wherein a preferred embodiment of this invention is utilized with the machine.

Attention should now be directed to FIG. 2 wherein a coin wrapping machine 20 (again of the same general type as shown in FIG. 1) is illustrated, which coin wrapping machine has its hopper 21, wrapping mechanism generally 22 and customary paper roll holder 23. A preferred embodiment of this invention 24 is shown, however, to consist of a base 25 having a pair of angularly converging arms 26 and 27 suitably welded or otherwise joined at their upper end, together with roller holding arm 28 suitably welded or otherwise joined to arm 27 as indicated. Roller 29 is fastened to arm 28 by means of appropriate bolts or the like and suitable bearing surfaces so that it is freely rotatable.

Bracket 32 has been provided and attached by welding or the like as shown for the purpose of holding guide rod 30, which is likewise suitably fastened by a bolt or the like, but is not rotatable. A spacer 31 of suitable metal or the like is provided between the flanges of the coin wrapping paper roll holder 23 which spacer will be of varying dimensions depending upon the thickness of the particular paper being used, since the width of the paper varies depending upon the exact roll of coins being wrapped.

Figure 3:
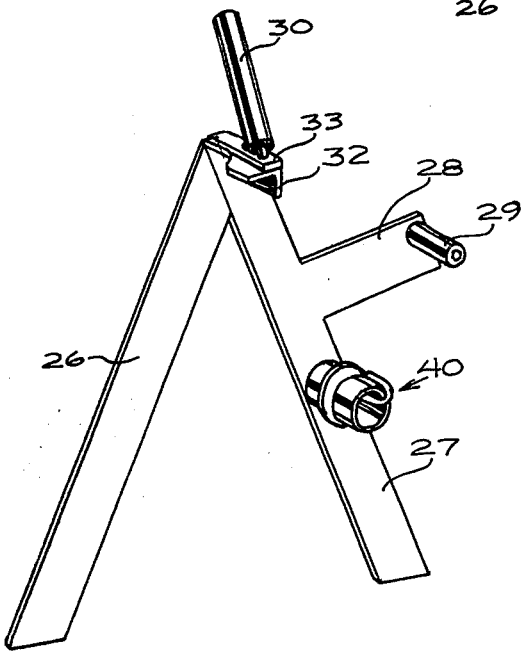
FIG. 3 is a partial perspective of a portion of the embodiment of FIG. 2 showing the angular relationship of the guide bar and roller for the auxiliary roll of paper.

FIG. 3 illustrates in a somewhat better view away from the machine, the elements of importance in the guiding of the roll. The base has been left off in this case so as to illustrate the spindle for the large type roll of paper, and the positioning of the two guides (the roller 29 and the fixed guide 30). It will be noted that there is an adjustment for the angular positioning of the fixed (non-rotatable) guide 30 so that the correct adjustment may be made for variations in the width of the paper in order to provide the correct and proper angular relationship for the feeding. This is an easy matter of adjustment during the initial stages of feeding a large roll of paper 50 into the machine.

Figure 4:
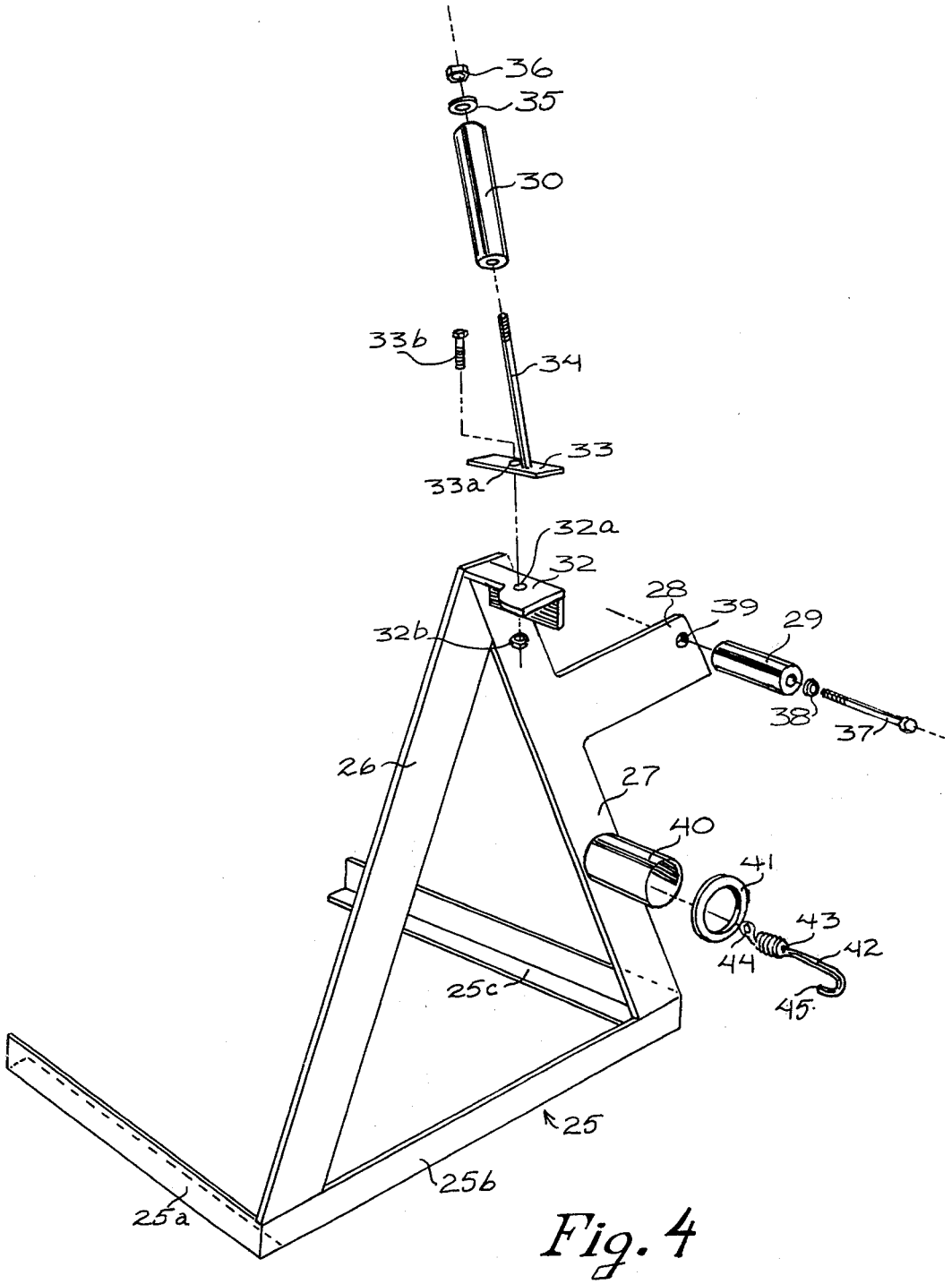
FIG. 4 is an exploded view of the embodiment of this invention shown in FIG. 2.

The exploded view, FIG. 4, shows in somewhat more detail the manner in which the embodiment of this invention which is described has been constructed. The base 25 is shown to consist of three pieces of angle iron or the like **25*a*, 25*b*, and 25*c*, which are welded or otherwise suitably joined together and upon which the machine 20 rests. The two arms 26 and 27 are suitable welded or otherwise joined together and the arm 28 is suitably welded or otherwise joined to arm 27. Bracket 32 is likewise welded or otherwise suitably fastened to the upper portion of the joined arms 26 and 27, and is provided with a hole 32*a*. Adjustment plate 33 for guide bar 30, is also provided with a hole 33*a* therethrough. By inserting bolt 33*b* through holes 33*a* and 32*a*, and by securing said bolt with a nut 32*b*, adjustment plate 33 is held firmly in the desired position upon bracket 32. Guide bar 30 is mounted upon a bolt or the like 34 and fastened tightly with suitable nut and washer 36 and 35 respectively, which washer may be a lock washer or the like if desired in order to prevent turning of the guide bar 30**. It has been found important that this bar not turn freely in order to achieve proper feeding of the paper.

Roller 29 on the other hand is suitably fastened through hole 39 by bolt of the like 37, with appropriate bearing arrangements 38 or the like so as to be freely rotatable.

The spindle 40 for the paper is welded or otherwise suitably attached to arm 27 and the flange 41 slides over spindle 40 and is held in tension contact against the paper roll by means of hook 42 which is fastened at one end to spring 43 which has means to be fastened by bolts or otherwise to the arm 27 on the interior. This is by means known to those skilled in the art and no particular definition of this has been given since it will merely make a small hole in the center of the spindle 40 at its connection to 27, through the arm 27 with a small bolt to fasten the loop 44 to the arm 27. The end 45 of the hook 42 presses, then, against the ring 41 under the tension spring 43 to provide tension upon the roll of paper so it does not rotate overly freely and maintains proper tension for proper feeding.

The embodiment of this device shown in these figures will be readily adaptable by those skilled in the art to other types of paper roll using machines, such as large cash registers and the like. In those cases where the paper may already be vertically disposed within the large cash register, the guide bars 29 and 30 may not be required. A spacer 31 in the normal paper roll portion of the machine, however, will normally be necessary. Even in the large machines which might use a vertically disposed roll, however, it will generally be desirable to have the roll 29 since this will maintain a constant positioning of the paper with relation to its normal paper carrier. This should be apparent to those skilled in the art.

While the embodiment of this invention shown and described is fully capable of achieving the objects and advantages desired, it is to be understood that this embodiment has been shown for purposes of illustration only, and not for purpose of limitation.

I claim:

1. A device for feeding a roll of paper to a roll paper utilizing machine including, in combination with a roll paper means within the roll paper utilizing machine; (1) means to connect to said machine; (2) means to rotatably hold a roll of paper for utilization within said machine in parallel relationship to the base of said machine; (3) means cooperative with said means to hold said roll of paper to guide the paper from said roll to said machine; (4) adaptor means fastened within the roll paper means within said machine so as to allow free movement of paper being fed into said machine; wherein tensioning means are provided cooperative with said paper holding means so as to maintain uniform tension against rotation; said guide means comprises a fully rotatable roller in parallel relationship to the paper roll holding means; and a non-rotatable guide bar is associated with said roller in such manner as to guide paper from said roller into said machine at a 90° relationship to the axis of said roller.

2. The device of claim 1 wherein said guide bar is adjustably mounted relative to said guide roller.

3. A device for providing paper from a roll to a paper using machine comprising: (1) A base adapted to cooperate with the base of said machine; (2) said base comprising a front base member having two side base members fixed, one at each of its ends; (3) a first arm fastened to one end of said front base member and extending vertically therefrom and angularly disposed towards the other end of said front base member; (4) a second arm extending vertically from the other end of said front base member and angularly disposed towards the other end of said front base member in such manner that the two said arms are joined at their upper extremity and form an essentially triangular member in combination with the said front base member; (5) a spindle for carrying a roll of paper fixed to said second angularly disposed arm; (6) a third arm fixed to said second arm at an angular relationship thereto; (7) a guide roller fixed to the end of said third arm; (8) paper tensioning means slideably connected to said spindle means; (9) guide bar bracket means attached to the upper connection of said first and second arms; (10) guide bar holding means adjustably connected to said guide bar bracket means; (11) a guide bar held by said guide bar holding means; and (12) spacer means adapted to mount within the paper feed mechanism of the machine.

* * * * *